US009108820B2

(12) United States Patent
Tobishima

(10) Patent No.: US 9,108,820 B2
(45) Date of Patent: Aug. 18, 2015

(54) SHEET FOLDING APPARATUS AND IMAGE FORMING APPARATUS

(71) Applicant: Toshiaki Tobishima, Saitama (JP)

(72) Inventor: Toshiaki Tobishima, Saitama (JP)

(73) Assignee: Ricoh Company, LTD., Tokyo (JP)

( * ) Notice: Subject to any disclaimer, the term of this patent is extended or adjusted under 35 U.S.C. 154(b) by 254 days.

(21) Appl. No.: 13/790,381

(22) Filed: Mar. 8, 2013

(65) Prior Publication Data

US 2013/0244848 A1 Sep. 19, 2013

(30) Foreign Application Priority Data

Mar. 19, 2012 (JP) ..... 2012-062782
Jan. 21, 2013 (JP) ..... 2013-008594

(51) Int. Cl.
*B65H 45/04* (2006.01)
*B65H 45/12* (2006.01)

(52) U.S. Cl.
CPC ..... *B65H 45/04* (2013.01); *B65H 45/12* (2013.01); *B65H 2801/27* (2013.01)

(58) Field of Classification Search
CPC ..... B65H 45/04; B65H 45/20
USPC ..... 493/18, 413, 415, 421, 427, 430, 433, 493/435, 438, 442, 445, 451; 270/39.01
See application file for complete search history.

(56) References Cited

U.S. PATENT DOCUMENTS 5,768,677 A * 6/1998 Natsume ..... 399/376
6,641,132 B2 11/2003 Sekine
7,016,090 B2 3/2006 Sekine
7,470,227 B2 12/2008 Sekine et al.
7,503,886 B2 3/2009 Sekine et al.
7,802,778 B2 * 9/2010 Kurita ..... 270/39.01
8,246,030 B2 8/2012 Sekine
2010/0019433 A1 1/2010 Sekine

FOREIGN PATENT DOCUMENTS

EP 2112112 A2 * 10/2009
EP 2394941 A1 * 12/2011
JP 05-238635 9/1993
JP 11-349218 12/1999
JP 2004067266 A 3/2004
JP 2006219290 A * 8/2006
JP 2006225067 A * 8/2006
JP 2006-335500 12/2006
JP 3911091 B2 5/2007
JP 2011256018 A * 12/2011
JP 2012-240811 12/2012

* cited by examiner

*Primary Examiner* — Leslie A Nicholson, III
(74) *Attorney, Agent, or Firm* — Harness, Dickey & Pierce, P.L.C.

(57) ABSTRACT

A sheet folding apparatus is disclosed, including a conveying roller pair; first and second folding roller pairs; first and second sheet detecting units; first and second sheet guiding members, a sheet conveyed from the conveying roller pair is guided to the first or second folding roller pair, a sheet edge is detected by the first or second sheet detecting unit, a sheet conveying direction and a sheet conveying distance are controlled based on the detected result, timings of an operation of the first or second sheet guiding member and conveying of the sheet by the first and second folding roller pair are aligned, and the sheet is folded while being placed by the first or second folding roller pair therebetween.

11 Claims, 11 Drawing Sheets

SHEET FOLDING APPARATUS AND IMAGE FORMING APPARATUS

TECHNICAL FIELD

The present invention generally relates to a sheet folding apparatus and an image forming apparatus and particularly relates to a sheet folding apparatus which is used for a post-processing apparatus, etc., of a body of an image forming apparatus such as a printing machine, etc., including a copying machine, a printer, a facsimile apparatus, a plotter, an inkjet recording apparatus, a stencil printing apparatus, etc., or a multi-functional machine having two or more functions thereof and the image forming apparatus which have mounted thereon this sheet folding apparatus.

BACKGROUND ART

In general, when an image forming apparatus is used which makes it possible to copy onto a large-sized sheet such as A0, A1, etc., if such a large-sized sheet is stored as it is or if the large-sized sheet is handled as it is, a storage space ends up becoming large, or handling thereof is inconvenient, so that normally the sheet is folded for storing and handling.

However, if a sheet folding operation is performed manually, a significant amount of time is needed, so that a time required for folding a sheet may end up being longer than a time required for copying.

In light of the above, there is a system in which is arranged, in a sheet discharge path of an image forming apparatus, a sheet folding apparatus which can fold a sheet automatically, making it possible to automatically fold in succession large-sized sheets copied (Patent Documents 1-4).

In a sheet folding apparatus for use in such a system, there may be included a unit (an off-line operation) for folding a sheet which was inadvertently copied and discharged without folding in advance, or a large-sized sheet which was produced by a different image forming apparatus, etc., as well as (an on-line operation of) automatically folding a sheet discharged from an image forming apparatus.

When paper folding is actually performed by such a system, for a standard-sized sheet such as A0, A1, etc., paper folding can be performed using a predetermined size for each face of a sheet to be folded. In an image forming apparatus which can copy onto the large-sized sheet, copying may be performed onto a long sheet such that a length in a sub-scanning direction amounts to several meters, so that it is required to perform paper folding even for such a non-standard long sheet.

A paper folding apparatus disclosed in Patent Document 1 automatically adjusts a folded length of each folded portion to fold even a sheet other than one having a standard length to a specified dimension. Patent Document 2 discloses a paper folding method and a paper folding mechanism that orderly form a folding edge in a desired folding mode, while Patent Document 3 discloses a paper folding machine which ensures that unnecessary folds are not produced when a folded sheet is discharged. Patent Document 4 discloses a paper folding apparatus which reduces unevenness in a folding dimension even for a large-sized sheet whose tip is curled.

Below, an explanation of an image forming apparatus and a sheet folding machine according to a related art is provided in accordance with a schematic configuration indicated in the drawings.

FIG. 1 is a diagram showing a schematic configuration of a related-art image forming apparatus to which the present invention is applied as well a schematic configuration of an image forming apparatus which shows one embodiment of the present invention. In FIG. 1, a number 200 denotes a copying machine, which is one form of an image forming apparatus body. A number 300 to which parentheses are affixed is an example of a related-art sheet folding machine which is arranged in a sheet discharging path of the image forming apparatus body 200, while a number 500 to which parentheses are affixed is an example of a related-art sheet folding apparatus. A number 1000 to which parentheses are affixed denotes a related-art image forming apparatus or image forming system in which a related-art sheet folding machine 300 is connected and mounted to the image forming apparatus body 200.

In FIG. 1, with respect to numbers to which parentheses are not affixed, a number 50 is a sheet folding machine which shows one embodiment of the present invention; a number 1 is a sheet folding apparatus which shows one embodiment, etc., of the present invention; and a number 100 is an image forming apparatus or image forming system which is configured with a sheet folding machine 50 to be a post-processing apparatus being mounted to the image forming apparatus body 200.

In the image forming apparatus body 200, a sheet P which is fed from a paper feeding unit 209 or a manual paper-feeding unit 208 is conveyed by a fed-paper conveying unit 210, and an image is formed thereon by an image forming unit 220, after which it is discharged out of the image forming apparatus body 200 by a discharged-paper conveying unit 230. The sheet P, which is discharged out of the image forming apparatus body 200, enters a sheet receiving unit 21 of the sheet folding machine (300) that is arranged in a sheet discharging path of the image forming apparatus body 200, and is conveyed to the sheet folding apparatus (500) by the feeding unit 20.

The sheet folding apparatus (500) includes a conveying roller pair 3; a first folding roller pair 6 and a second folding roller pair 7 that are arranged in an opposing manner to the left and the right of a lower portion thereof; a first sheet guiding member 4 and a second sheet guiding member 5 that selectively guide a sheet P conveyed from the conveying roller pair 3 in each folding roller pair direction; and a lower sheet face guide 10 which guides a lower face of the sheet P. The sheet P is fed by the conveying roller pair 3 and conveyed, and selectively guided to the first folding roller pair 6 or the second folding roller pair 7 by an operation of the first sheet guiding member 4 or the second sheet guiding member 5. The guided sheet P is folded a predetermined number of times by being fed between the first folding roller pair 6 or the second folding roller pair 7 while sliding on an upper face of the lower sheet face guide 10 by an operation of the first sheet guiding member 4 or the second sheet guiding member 5 in alignment with repeating of forward and reverse rotations of the first folding roller pair 6 and the second folding roller pair 7. In FIG. 1, a number 2 denotes an inlet sensor which is to be a sheet detecting unit which is arranged between the feeding unit 20 and the conveying roller pair 3 and which detects a tip of the sheet P which is conveyed from the feeding unit 20. The inlet sensor 2 is to be a trigger signal for operation control at and after the detecting time. Moreover, toward the right in an upper portion of the sheet folding machine (300) is arranged a manual insert tray for placing thereon and feed a copied sheet P, for example.

However, in the above-described related-art sheet folding apparatus (500), the sheet P is folded a predetermined number of times by being fed between the first folding roller pair 6 or the second folding roller pair 7 while being slid on an upper face of the lower sheet face guide 10 by an operation of the first sheet guiding member 4 or the second sheet guiding member 5 in alignment with repeating of forward and reverse rotations of the first folding roller pair 6 and the second folding roller pair 7, so that a resulting state thereof becomes a zigzag fold.

As described above, in the related-art sheet folding apparatus (500), the sheet P is folded alternately by the first folding roller pair 6 and the second folding roller pair 7. Thus, while folding is possible without being affected by the length of the sheet or the number of times of folding, it is only possible to alternately perform trough folding in which folding is performed with an image face facing inside and crest folding in which folding is performed with an image face facing outside, and it is not possible to successively perform trough folding or to successively perform crest folding.

Even in folding methods described in JIS (Z8311: Technical Drawings-Sizes and Layout of Drawing Sheets, Appendix (Reference): Standard Methods of Folding Drawings) that are generally well known drawing sheet folding methods is included a folding method in which crest folding is repeated. A folding finishing state shown in FIG. 2A is a state in which an A0-sized sheet is folded, resulting in basic folding, which is described in JIS in the above. In this case, crest folding is performed twice with a title column facing up. Moreover, in a similar manner, with respect to A0-sized bag folding, crest folding is performed twice with the title column facing up. This folding, which cannot be handled by the related-art sheet folding apparatus, is handled by performing crest folding and trough folding from the title column side as shown in FIG. 2B.

Besides the foldings described in JIS, there are folds which require finishing in which there are successive folds in the same direction; these are folds which are often used in notices, brochures, etc., such as an inner three fold as shown in FIG. 3A and a gate fold as shown in FIG. 3B. However, the related-art sheet folding apparatus cannot handle these common folding specifications, so that specification is changed, or folding is done manually.

PATENT DOCUMENTS

Patent Document 1 JP5-238635A
Patent Document 2 JP11-349218A
Patent Document 3 JP2004-67266A
Patent Document 4 JP2006-335500A

DISCLOSURE OF THE INVENTION

In light of the problems and circumstances as described above, a main object of the present invention is to realize and provide a sheet folding apparatus which makes it possible to successively perform trough folding or to successively perform crest folding as well as to alternately perform crest folding and trough folding that is possible by a related-art sheet folding apparatus; and an image forming apparatus which has mounted thereon the sheet folding apparatus.

According to an embodiment of the present invention, a sheet folding apparatus is provided, including: a conveying roller pair which feeds a sheet; a first roller pair which folds the sheet fed from the conveying roller pair; a second folding roller pair which folds the sheet fed from the conveying roller pair in conjunction with the first folding roller pair which is arranged in an opposing manner and at a predetermined gap therewith; a first sheet detecting unit which detects a sheet edge on the first folding roller pair side and a second sheet detecting unit which detects a sheet edge on the second folding roller side, which first sheet detecting unit and second sheet detecting unit are arranged outside an opposing area of the first folding roller pair and the second folding roller pair; a first sheet guiding member which is operable to guide the sheet fed by the conveying roller pair to the first folding roller pair; and a second sheet guiding member which is arranged on the side opposing the first sheet guiding member and which is operable to guide to the second folding roller pair, wherein the first sheet guiding member and the second sheet guiding member are operated in accordance with a specified sheet folding scheme, the sheet conveyed from the conveying roller pair is guided to the first folding roller pair or the second folding roller pair, a sheet edge is detected by the first sheet detecting unit or the second sheet detecting unit, a sheet conveying direction and a sheet conveying distance are controlled based on the detected result, timings of the operation of the first sheet guiding member or the second sheet guiding member and conveying of the sheet by the first folding roller pair and the second folding roller pair are aligned, and the sheet is folded while being placed by the first folding roller pair or the second folding roller pair therebetween, wherein the sheet folded portion is detected by the first sheet detecting unit or the second detecting unit and in accordance with control of the sheet conveying direction and the sheet conveying distance based on the detected result, the sheet folded portion for which folding was performed by the first folding roller pair or the second folding roller pair is guided to either of the first folding roller pair and the second roller pair that are arranged in an opposing manner, the sheet folded portion is detected by the first sheet detecting unit or the second detecting unit and the sheet conveying direction and the sheet conveying distance is controlled based on the detected result, timings of the operation of the sheet guiding member and conveying of the sheet by the first folding roller pair and the second folding roller pair are aligned, and the sheet is folded while being placed by the first folding roller pair or the second folding roller pair therebetween.

According to the present invention, a sheet folded portion in which folding was performed by a first folding roller pair or a second folding roller pair is guided to the first folding roller pair or the second folding roller pair, the sheet folded portion is detected by the first sheet detecting unit or the second sheet detecting unit, a sheet conveying direction and a sheet conveying distance are controlled based on a result thereof, timings are aligned between conveying of a sheet by the first and second folding roller pairs and an operation of a first sheet guiding member or a second sheet guiding member, and the sheet is folded while conveying the sheet by the first folding roller pair or the second folding roller pair in a manner such that the sheet is placed therebetween, making it possible to successively perform trough folding or to successively perform crest folding as well as to alternately perform crest folding and trough folding.

BRIEF DESCRIPTION OF THE DRAWINGS

Other objects, features, and advantages of the present invention will become more apparent from the following detailed descriptions when read in conjunction with the accompanying drawings, in which.

BEST MODE FOR CARRYING OUT THE INVENTION

Below embodiments of the present invention are described in detail with reference to drawings. For elements (parts, components, etc.,) having the same function, shape, etc., over embodiments, variations, etc., the same letters are affixed, so that repeated explanations are omitted after having been explained once unless there is a possibility of confusion. For brevity and clarity of the figures and explanations, even for those elements to be shown in a figure, elements which do not need specific explanations in the figure may be omitted as needed without any explanatory notes. For providing an explanation with reference to an element of a printed patent publication, etc., as it is, parentheses are provided to a letter thereof, so that it is to be distinguished from that in the respective embodiments, etc.

A basic configuration of embodiments of the present invention is described with reference to FIGS. 4 to 13.

Figure 4:
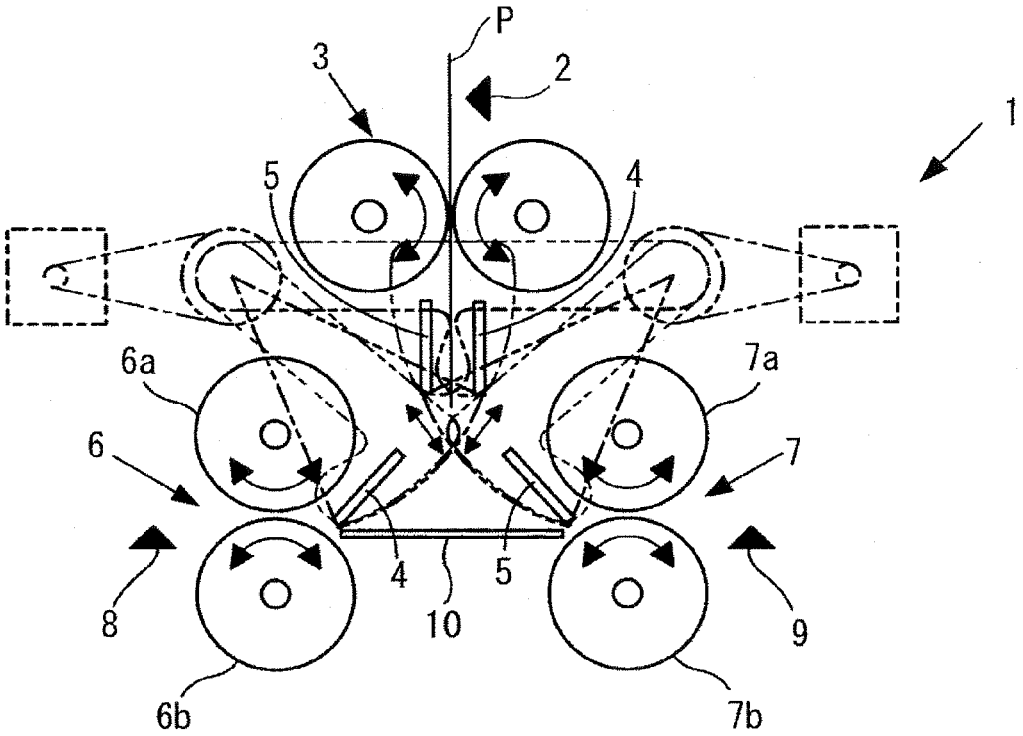
FIG. 4 is an overall configuration diagram showing one embodiment of a sheet folding apparatus according to the present invention.
Figure 5:
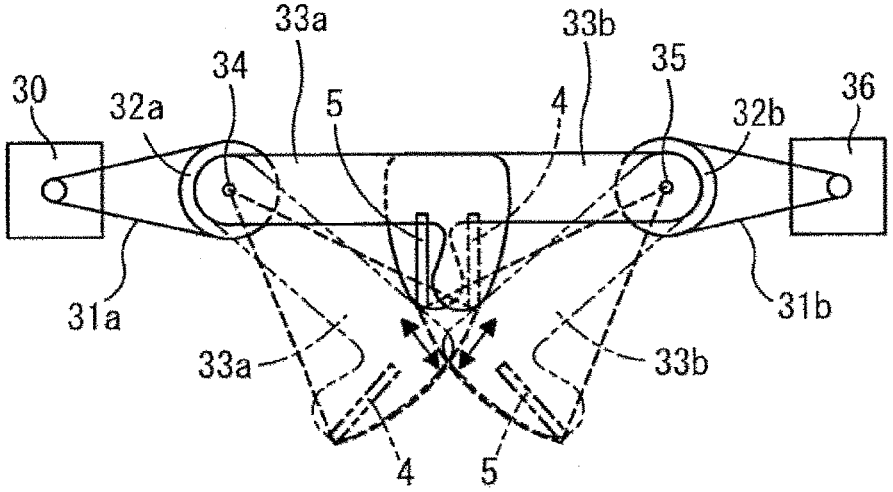
FIG. 5 is a schematic front view showing a drive system of first and second sheet guiding members of the sheet folding apparatus in FIG. 4.

FIG. 4 is a configuration diagram for an overall sheet folding apparatus 1 according to the embodiment of the present invention. FIG. 5 is an example of a driving system of the first sheet guiding member 4 and the second sheet guiding member 5 of the sheet folding apparatus 1 in FIG. 4. Round chamfering or roundness to prevent an occurrence of a scratch, etc., due to a contact with a sheet P that is applied on the respective tips of the first sheet guiding member 4 and the second sheet guiding member 5 is omitted in the below-described drawings including FIG. 4 for brevity.

As shown in FIG. 4, the sheet folding apparatus 1 includes a conveying roller pair 3, which is to be a conveying rotating member pair which feeds the sheet P. The sheet folding apparatus 1 includes a first folding roller pair 6 to be a first folding rotating member pair and a second folding roller pair 7 to be a second folding rotating member pair that are arranged, with a predetermined gap therebetween, in an opposing manner at the left and the right in a lower portion of the conveying roller pair 3. The sheet folding apparatus 1 includes a first sensor 8 to be a first sheet detecting unit which detects a sheet P edge (including a sheet P edge portion and a folding edge portion) on the first folding roller pair 6 side and a second sensor 9 to be a second sheet detecting unit which detects a sheet P edge on the second folding roller pair side that are arranged outside an opposing region of the first folding roller pair 6 and the second folding roller pair 7. The sheet folding apparatus 1 includes a first sheet guiding member 4 to be a first sheet guiding member which can undergo fluctuating displacement and operation to guide, to the first folding roller pair 6, the sheet P which is fed by the conveying roller pair 3 in accordance with a sheet folding method specified and a second sheet guiding member 5 to be a second sheet guiding member which can undergo fluctuating displacement and operation to guide, to the second folding roller pair 7, the sheet P which is fed by the conveying roller pair 3 in accordance with a sheet folding method specified. The sheet folding apparatus 1 includes a lower sheet face guide 10 to be a lower sheet face guiding member which guides the sheet P guided by the first sheet guiding member 4 or the second sheet guiding member 5 to a nip portion between the respective rollers 6*a* and 6*b* of the first roller pair 6 or the respective rollers 7*a* and 7*b* of the second roller pair 7.

Figure 1:
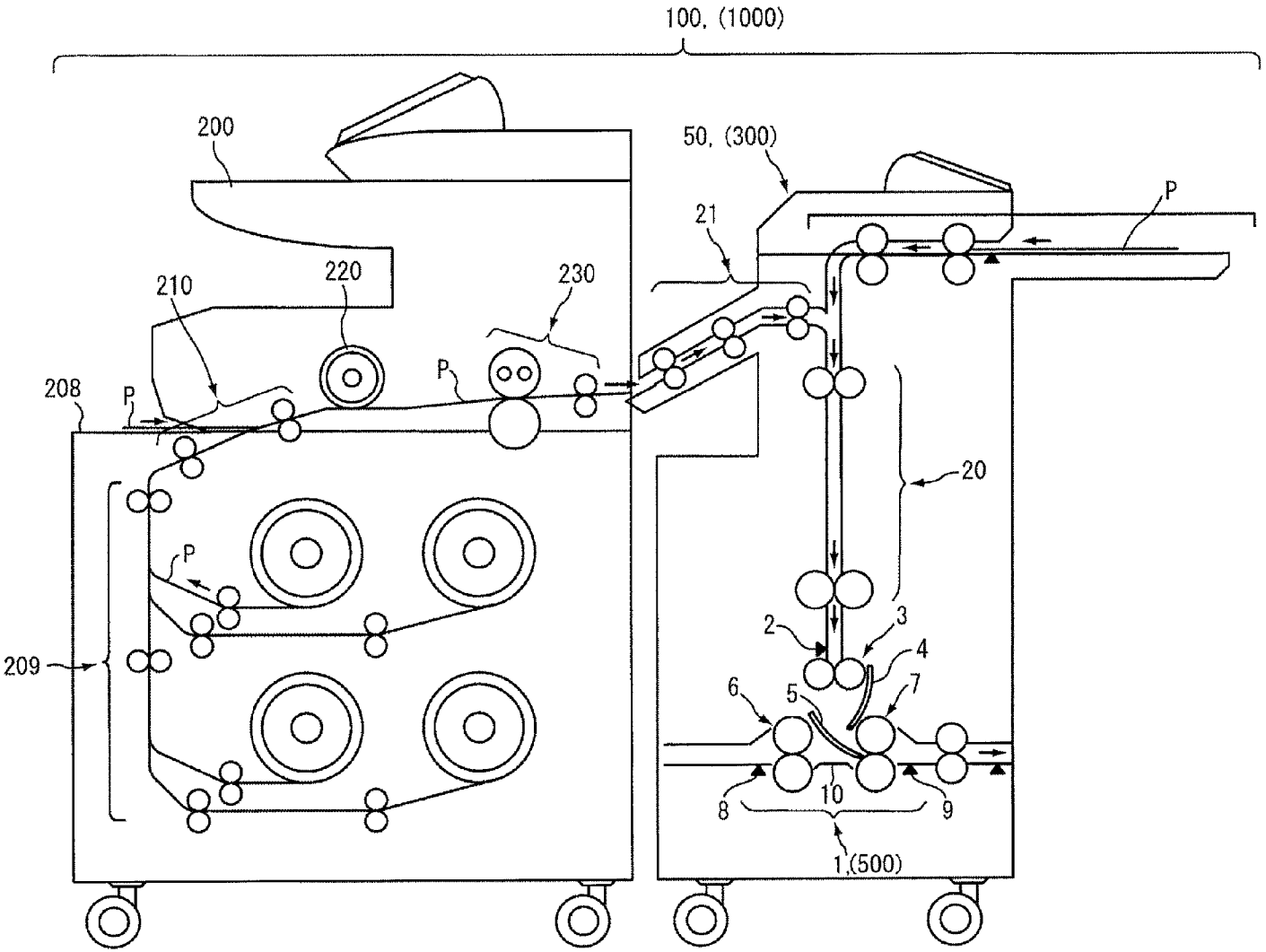
FIG. 1 is a diagram showing a schematic configuration of a related-art image forming apparatus to which the present invention is applied as well as a schematic configuration of an image forming apparatus which shows one embodiment of the present invention.
Figure 2A:
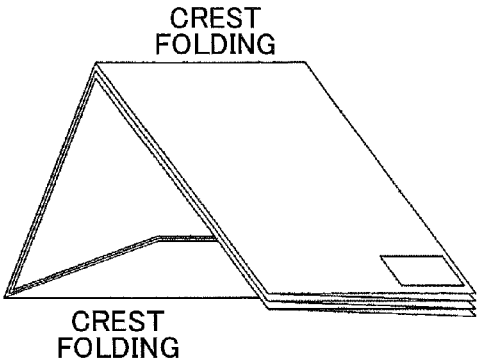
FIG. 2A is a perspective view showing a resulting folding state described in JIS.
Figure 2B:
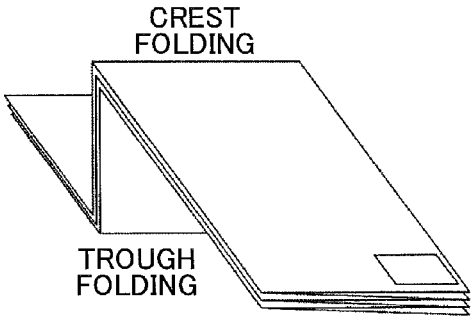
FIG. 2B is another perspective view showing the resulting folding state described in JIS.
Figure 3A:
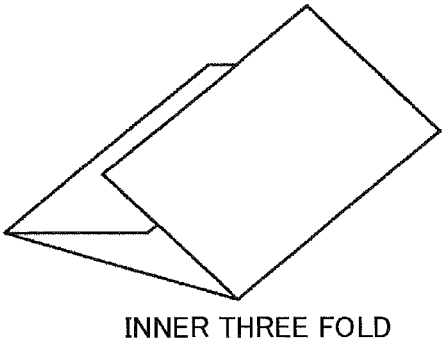
FIG. 3A is a perspective view showing an inner three fold.
Figure 3B:
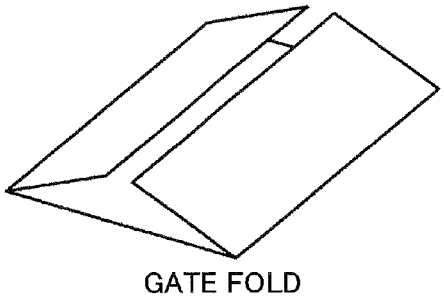
FIG. 3B is a perspective view showing a gate fold.

The conveying roller pair 3, the first folding roller pair 6, and the second folding roller pair 7 are supported by the apparatus body via an axle respectively such that they can undergo forward and reverse rotations. The first sheet guiding member 4 or the second sheet guiding member 5 is also a member which selectively guides, to the respective folding roller pairs 6 and 7 directions, the sheet P which is conveyed from the conveying roller pair 3. In FIG. 4, a letter 2 denotes an inlet sensor, shown in FIG. 1, which is to be a sheet detecting unit which is arranged between the conveying roller pair 3 and the feeding unit 20 shown in FIG. 1, and which detects a tip of the sheet P which is conveyed from the feeding unit 20. The inlet sensor 2 is to be a trigger signal for use in control of an operation of each member, motor, etc., at and after a timing of detecting thereof.

The sheet P is conveyed by the conveying roller pair 3 and selectively guided to the first folding roller pair 6 or the second folding roller pair 7 by a displacement operation of the first sheet guiding member 4 or the second sheet guiding member 5. If it is guided to the first folding roller pair 6 side, a tip or a folding edge of the sheet P is detected by the first sensor 8 and, with this detected time as a reference, the first folding roller pair 6 undergoes a reverse rotation after being conveyed for a required distance. If it is guided to the second folding roller pair 7 side, a tip or a folding edge of the sheet P is detected by the second sensor 9. With this detected time as a reference, the second folding roller pair 7 undergoes a reverse rotation after being conveyed for a required distance, a tip or a folding edge of the sheet P is detected by the second sensor 9 and, with this detected time as a reference, the second folding roller pair 7 undergoes a reverse rotation after being conveyed for a required distance. In alignment with this reverse rotation, the first sheet guiding member 4 is caused to undergo a displacement operation at a time of conveying to the first folding roller pair 6 and the second sheet guiding member 5 is caused to undergo a displacement operation at a time of conveying to the second folding roller pair 7. Then, being guided by the first sheet guiding member 4 or the second sheet guiding member 5 from inside a sheet folded portion Pb of the sheet P, a lower face of the sheet P is folded a predetermined number of times by being slid on an upper face of the lower sheet face guide 10 and fed to the first folding roller pair 6 or the second folding roller pair 7 toward which there is a conveying direction.

As shown in FIG. 5, a driving system for the first sheet guiding member 4 includes a sheet guiding member driving arm 33*a;* a first sheet guiding member operating pivotal axle 34; a sheet guiding member driving pulley 32*a;* a sheet guiding member driving belt 31*a;* and a first sheet guiding member driving motor 30.

A driving system for the second sheet guiding member 5 includes a sheet guiding member driving arm 33*b;* a second sheet guiding member operating pivotal axle 35; a sheet guiding member driving pulley 32*b;* a sheet guiding member driving belt 31*b;* and a second sheet guiding member driving motor 36.

The driving system of the first sheet guiding member 4 and the driving system of the second sheet guiding member 5 are configured to be generally the same, so that explanations are given below with the driving system of the first sheet guiding member 4 being represented. The first sheet guiding member 4 is fixed to the arm 33*a*. The pulley 32*a* is supported to be able to turn, or in other words, to fluctuate within a predetermined angular range to one of side plates (the side of the side plate which is arranged on the front side of a sheet face) that is an immobile member (not shown) on the apparatus body side. The arm 33*a* is fixed to the pulley 32*a* with the operating pivotal axle 34. A motor 30, which is fixed to the side plate, is arranged in the vicinity of the pulley 32*a*, and a belt 31*a* is stretched between a motor pulley which is fixed to an output axle of the motor 30 and the pulley 32*a*, so that the motor 30, the pulley 32*a*, and the arm 33*a* are in a driving force transmitting relationship. With the driving system of the above-described configuration, the driving force of the motor 30 is transmitted to the arm 33*a* and a position of the first sheet guiding member 4 is changed to allow a displacement operation, making it possible to guide from inside a sheet folded portion Pb and a tip Pt of a sheet P (see FIGS. 6 and 7).

Even for the second sheet guiding member 5, a displacement operation which is similar to that for the first sheet guiding member 4 is performed, so that guiding is performed from inside the sheet folded portion Pb and the tip Pt of the sheet P. However, operations of the first sheet guiding member 4 and the second sheet guiding member 5 need to be performed independently. Therefore, the displacement operation of the second sheet guiding member 5 is performed by driving of the second sheet guiding member driving motor 36, which is independent of the first sheet guiding member driving motor 30. The pulley 32*b* and the arm 33*b* are fixed to the operating pivotal axle 34, which is supported to be able to fluctuate to the other of side plates (the side of the side plate which is arranged on the back side of a sheet face) not shown.

In FIG. 5, a position of the first sheet guiding member 4 which is fixed to the arm 33*a* (that is shown in a solid line) and a position of the second sheet guiding member 5 which is fixed to the arm 33*b* (that is shown in a solid line) are respective home positions. They show a position at which the first and second sheet guiding members 4 and 5 (shown in a long dashed double-short dashed line), which are fixed in a corresponding manner to arms 33*a* and 33*b*, undergo a displacement operation via a fluctuating displacement and operation of each arm 33*a* and 33*b* by driving of the respective motors 30 and 36.

Next, an operation of the present embodiment is described with reference to FIGS. 6 to 13. FIGS. 6 to 13 are schematic diagrams which show how trough folding is mainly performed in a successive manner.

Figure 6:
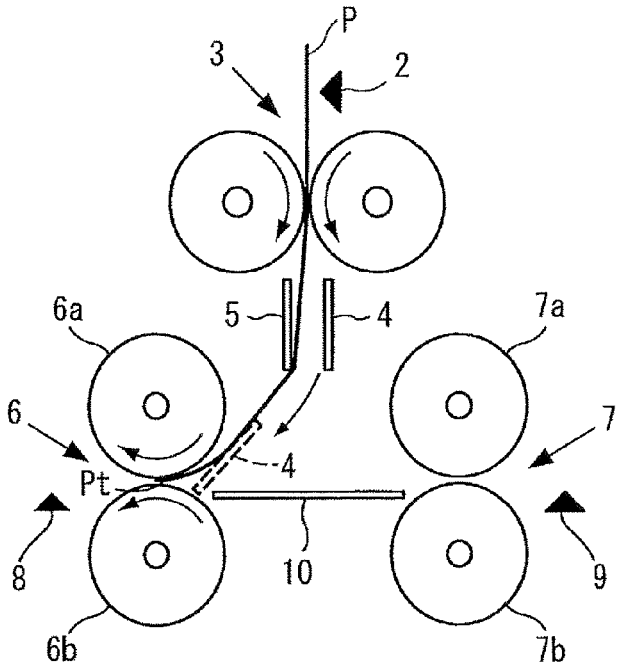
FIG. 6 is a schematic diagram showing an operation before carrying out folding in the sheet folding apparatus according to the present invention.

As shown in FIG. 6, in a home position state in which the first sheet guiding member 4 and the second sheet guiding member 5 are arranged in parallel such that they oppose each other, a tip Pt of the sheet P, which is conveyed by the conveying roller pair 3, which is rotating in an arrow direction shown is guided by a displacement operation of the first sheet guiding member 4. Then, as it is guided to the first folding roller pair 6, which is rotating in an arrow direction shown, and conveying thereof is continued, it enters a nip portion of the first folding roller pair 6, so that it is placed therebetween and conveyed, after which the tip Pt of the sheet P is detected by the first sensor 8. Before or after this operation, the first sheet guiding unit 4 undergoes a displacement operation and returns to an original home position.

Figure 7:
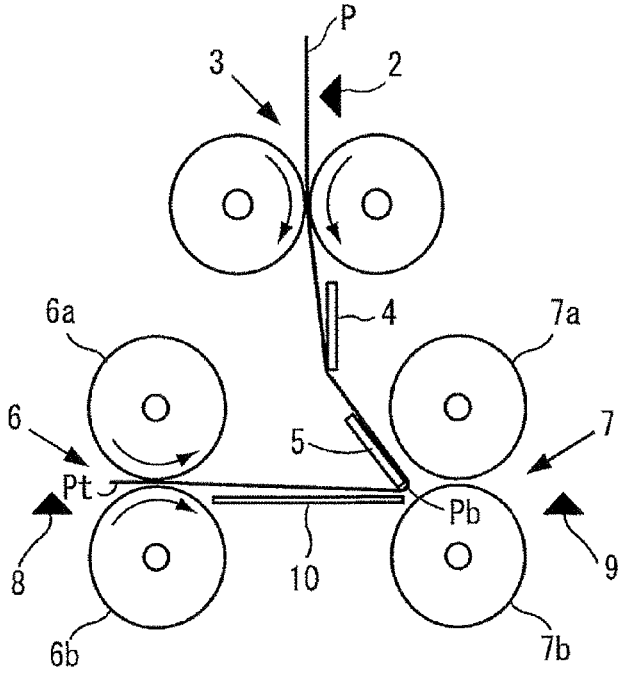
FIG. 7 is a schematic diagram showing an operation immediately before carrying out folding in the sheet folding apparatus according to the present invention.
Figure 8:
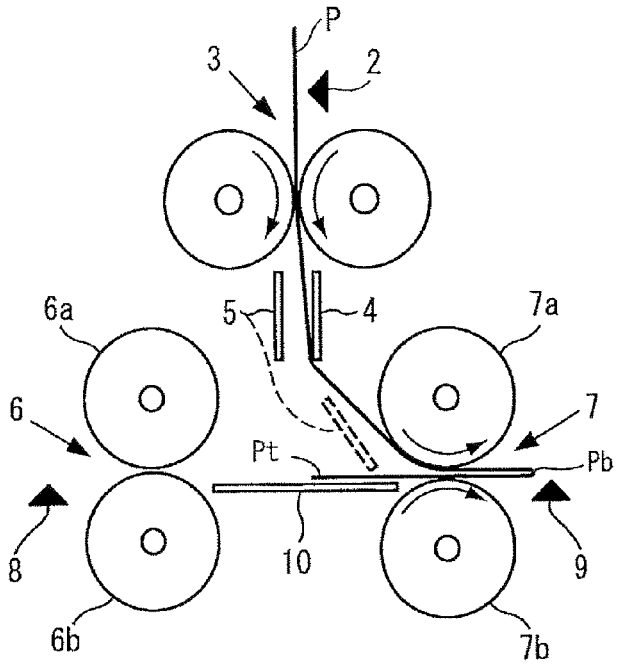
FIG. 8 is a schematic diagram showing an operation immediately after carrying out folding in the sheet folding apparatus according to the present invention.

Next, as shown in FIGS. 7 and 8, after conveying for a required distance with a detected timing of the first sensor 8 as a reference, the first folding roller pair 6 undergoes a reverse rotation as shown in FIG. 7. Then, the sheet folded portion Pb of the sheet P is guided from inside the sheet folded portion Pb by a displacement operation of the second sheet guiding member 5 and guided to the second folding roller pair 7, which is arranged in an opposing manner. As shown in FIG. 8, as conveying is continued, it enters a nip portion of the second folding roller pair 7 and is placed therebetween and conveyed, so that folding is formed. The folding edge formed is detected by the second sensor 9. Before or after this operation, the second sheet guiding member 5 undergoes a displacement operation and returns to an original home position.

Figure 9:
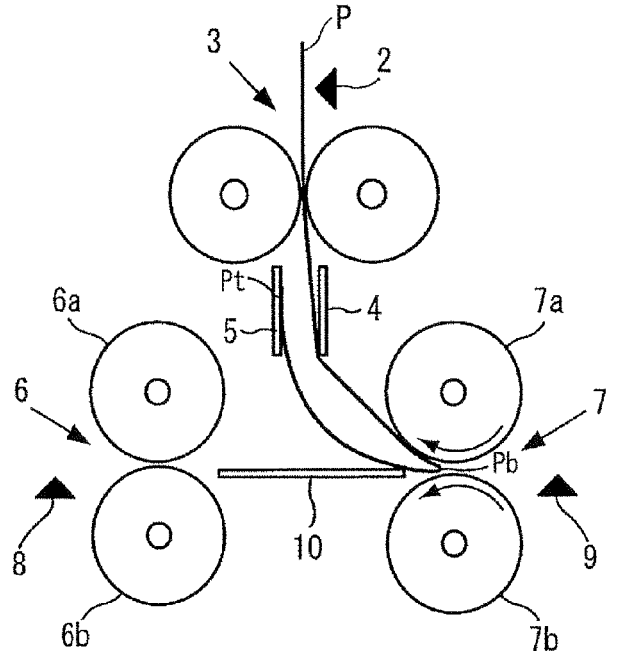
FIG. 9 is a schematic diagram showing a folded portion regriping operation 1 in the sheet folding apparatus according to the present invention.
Figure 10:
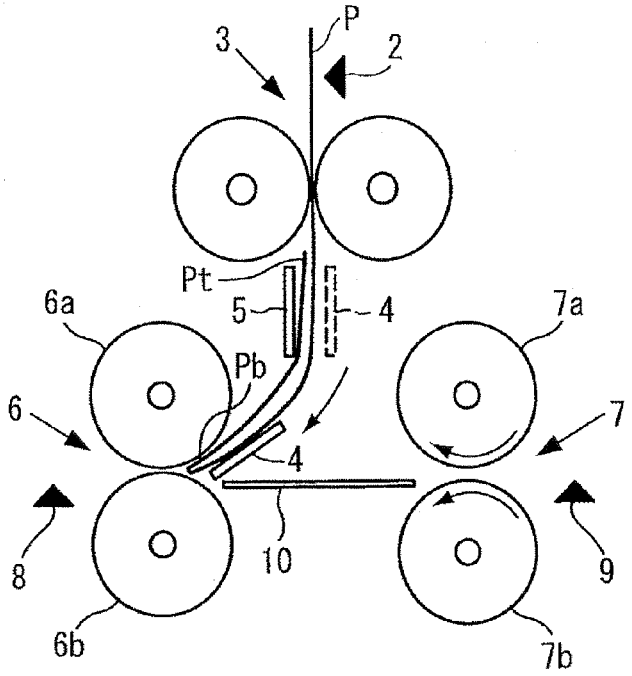
FIG. 10 is a schematic diagram showing a folded portion regriping operation 2 in the sheet folding apparatus according to the present invention.
Figure 11:
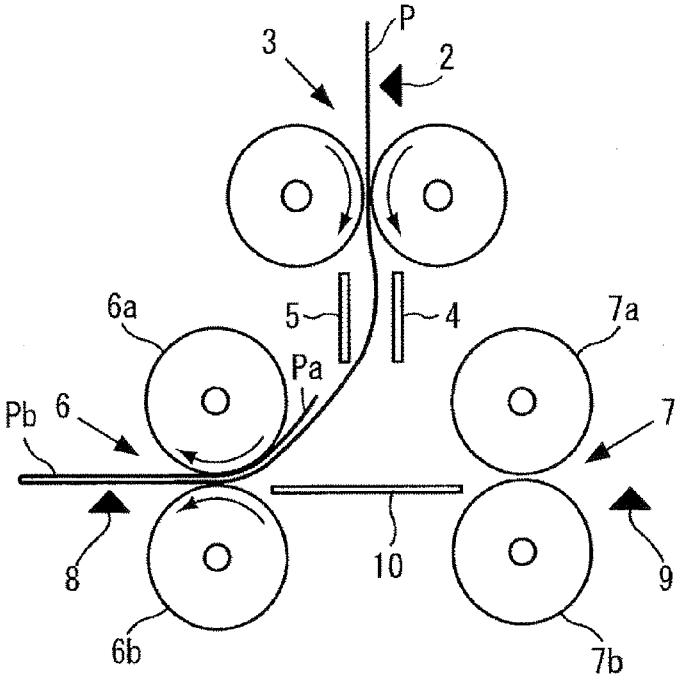
FIG. 11 is a schematic diagram showing a folded portion regriping operation 3 in the sheet folding apparatus according to the present invention.

Then, as shown in FIGS. 9 to 11, after conveying for a required distance with a detected timing of the second sensor 9 as a reference, the second folding roller pair 7 undergoes a reverse rotation as shown in FIG. 9. Then, the sheet folded portion Pb of the sheet P is conveyed to a direction of the first folding roller pair 6, which is arranged in an opposing manner, and passes through the nip. Thereafter, it is guided to the first folding roller pair 6 and is placed therebetween and conveyed as shown in FIG. 10 by an operation of the first sheet guiding member 4, and it is detected by the first sensor 8 as shown in FIG. 11.

Figure 12:
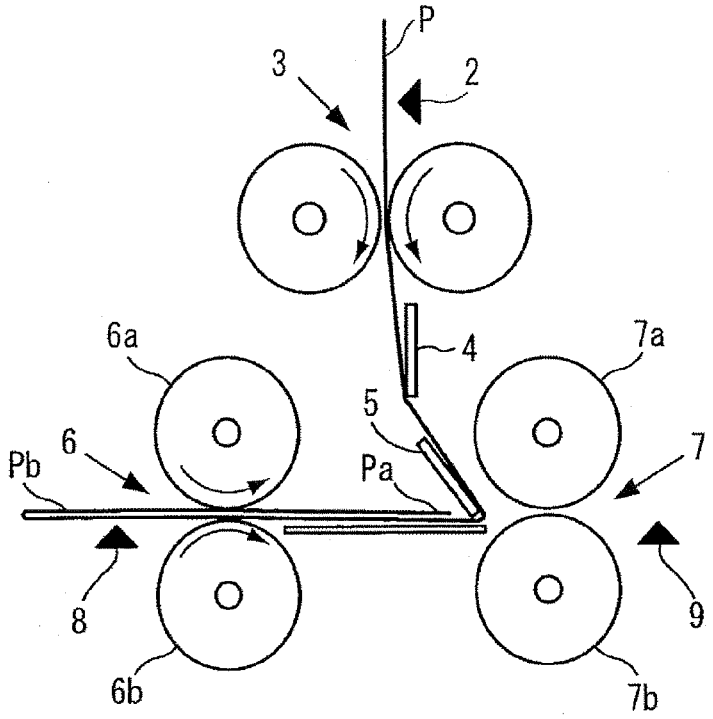
FIG. 12 is a schematic diagram showing an operation immediately before carrying out the same-direction folding in the sheet folding apparatus according to the present invention.
Figure 13:
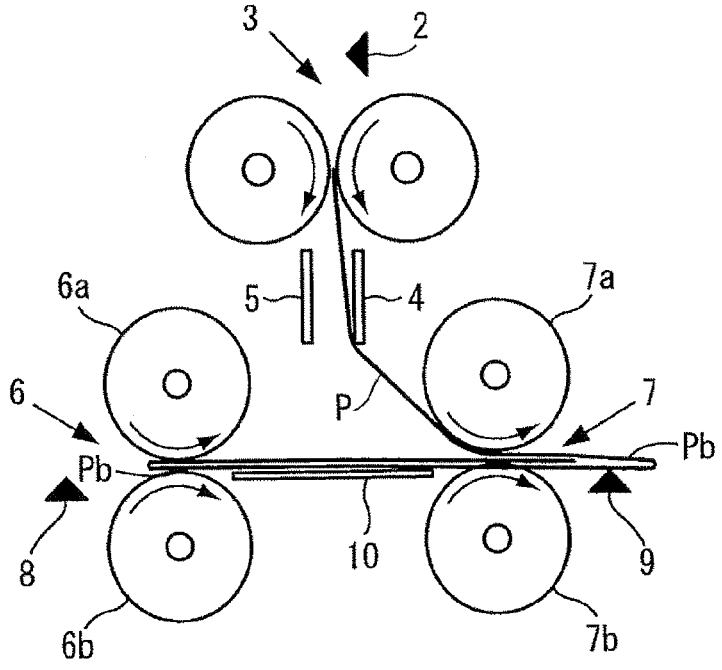
FIG. 13 is a schematic diagram showing an operation immediately after carrying out the same-direction folding in the sheet folding apparatus according to the present invention.

Then, as shown in FIG. 12, after conveying for a required distance with a detected timing of the first sensor 8 as a reference, the first folding roller pair 6 undergoes a reverse rotation. Then, the portion of the sheet P in which a second folding is carried out is guided from inside the sheet folded portion Pb by a displacement operation of the second sheet guiding member 5 and guided to the second folding roller pair 7, which is arranged in an opposing manner. It enters the second folding roller pair 7 and is placed therebetween and conveyed by continued conveying, so that the second folding is formed. As shown in FIG. 13, an edge of the second folding formed is detected by the second sensor 9. With this detection by the second sensor 9 as a reference, the following operation is selected.

As described above, according to the present embodiment, the sheet folded portion Pb for which folding was performed by the first folding roller pair 6 or the second folding roller pair 7 is guided to the first folding roller pair 6 or the second folding roller pair 7, which is arranged in an opposing manner, and the sheet folded portion Pb is detected by the first sensor 8 or the second sensor 9. Based on the detected result, control of a sheet conveying direction and a sheet conveying distance is performed, so that timings are aligned of an operation of the first sheet guiding member 4 or the second sheet guiding member 5 and conveying of a sheet by the first folding roller pair 6 or the second folding roller pair 7. Then, the sheet P is folded by the first folding roller 6 or the second folding roller 7 while it is placed therebetween and conveyed, making it possible to successively perform trough folding and successively perform crest folding in addition to zigzag folding in which crest folding and trough folding are alternately performed.

Figure 14A:
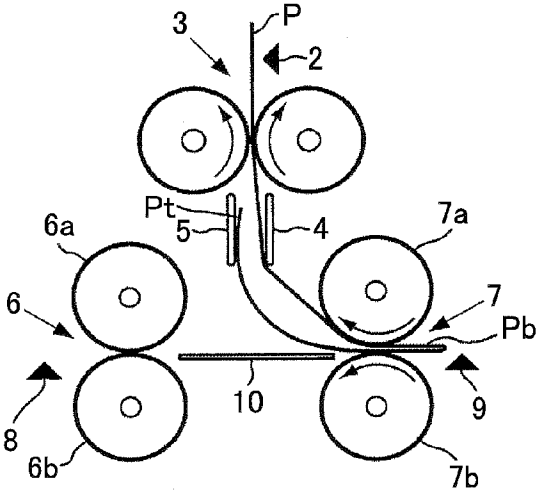
FIG. 14A is a diagram which shows a state in which a folding offset occurs when delivering a folded portion between an opposing folding roller pair of the sheet folding apparatus.
Figure 14B:
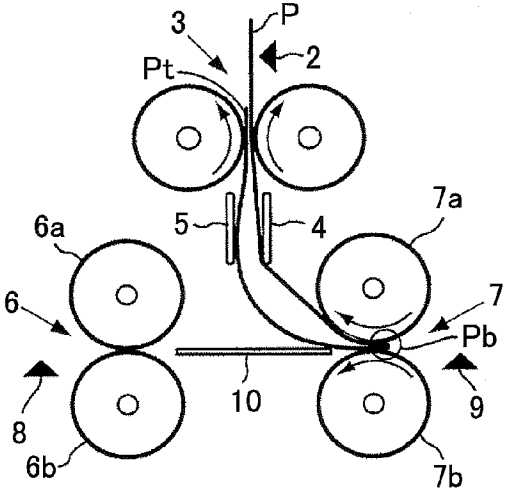
FIG. 14B is another diagram which shows a state in which a folding offset occurs when delivering a folded portion between an opposing folding roller pair of the sheet folding apparatus.
Figure 14C:
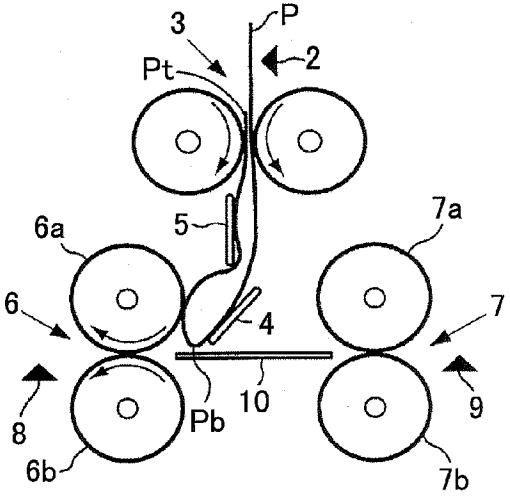
FIG. 14C is yet another diagram which shows a state in which a folding offset occurs when delivering a folded portion between an opposing folding roller pair of the sheet folding apparatus.

Now, in the above-described sheet folding apparatus 1, a folding offset as shown in FIGS. 14A to 14C may occur when the sheet folded portion Pb is delivered between the opposing first and second folding roller pairs 6 and 7. Here, FIG. 14A shows a state, which is similar to the above-described FIG. 9, in which a gap occurs between a face of a sheet folded portion Pb and thereafter, and a face between a sheet tip Pt and the sheet folded portion Pb. FIG. 14B shows a state in which the sheet tip Pt reenters the conveying roller pair 3 while the gap in FIG. 14A is present, where lengths of two faces between which is located a sheet folded portion Pb, which two faces are located between the second folding roller pair 7 and the conveying roller pair 3 differ. FIG. 14C shows a state in which the sheet folded portion Pb is guided from the second folding roller pair 7 to the first folding roller pair 6, in which state, when the first folding roller pair 6 places therebetween and conveys the sheet folding portion Pb, a folding offset occurs.

Figure 15:
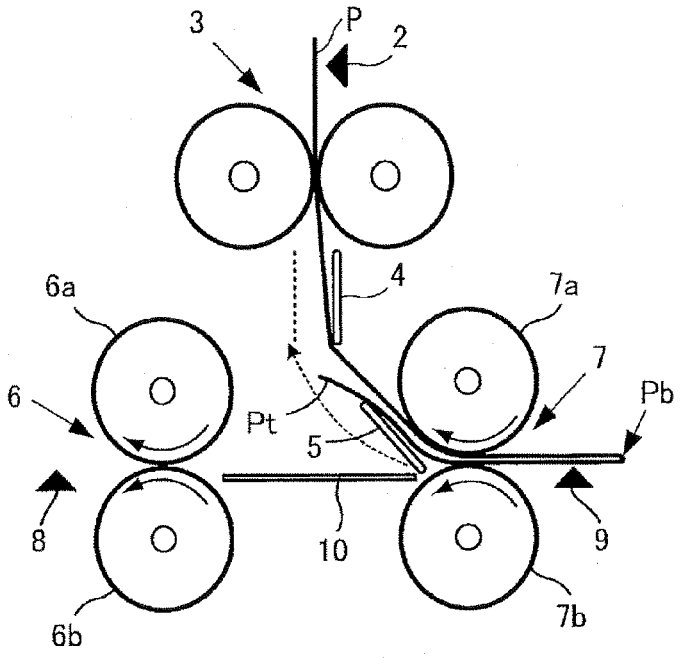
FIG. 15 is an schematic diagram illustrating an operation which guides a sheet tip from the first folding roller pair side of the second folding roller pair by an operation of the second sheet guiding member.
Figure 16:
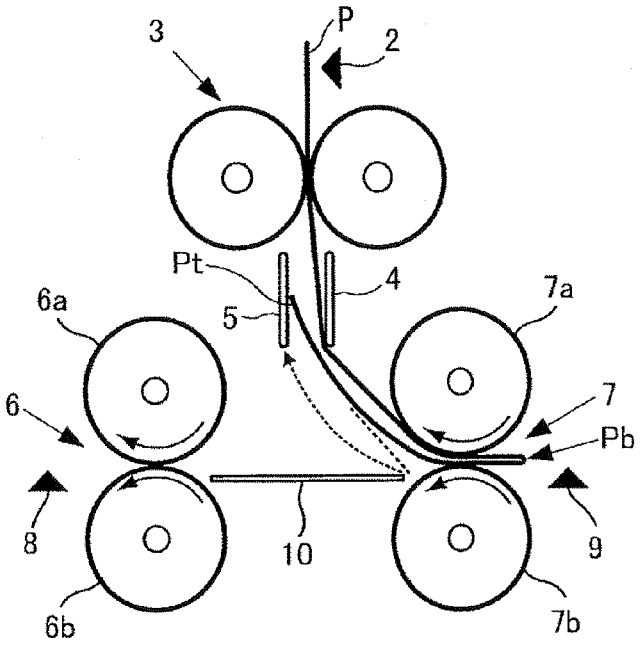
FIG. 16 is a schematic diagram illustrating an operation which guides to the conveying roller 3 by operating the second sheet guiding member in alignment with movement of the sheet tip.

An operation for suppressing the folding offset from occurring is described using FIGS. 15 to 19. FIGS. 15 and 16 are schematic diagrams showing, by an operation of the second sheet guide member 5 in an operation leading to FIG. 9, how the sheet tip Pt is guided from the first folding roller pair side of the second folding roller pair 7 and the second sheet guiding member 5 is operated in alignment with movement of the sheet tip Pt to guide it to the conveying roller pair.

Figure 17:
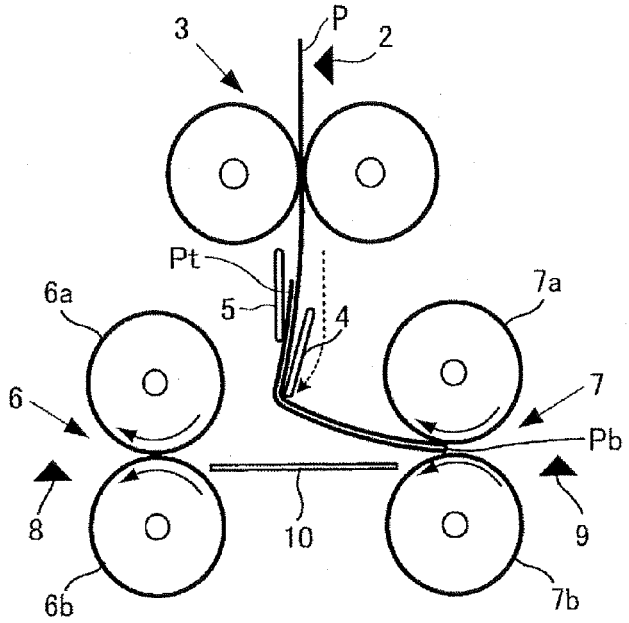
FIG. 17 is a schematic diagram showing an operation when transferring to an operation immediately before carrying out folding in FIG. 7 while a face before the sheet folded portion and a face after the sheet folded portion are placed by the first sheet guiding member and the second sheet guiding member therebetween, and a gap of the faces before and after the portion in which folding is carried out is reduced.

FIG. 17 shows an operation which continues to FIG. 9. More specifically, a transfer is made to an operation in FIG. while, using the first sheet guiding member 4 which is operable to guide the sheet folded portion Pb to the first folding roller pair 6 and the second sheet guiding member 5 which is operable to guide the sheet folded portion Pb to the second folding roller pair 7 that is arranged on the opposing side when the sheet folded portion Pb is guided from the second folding roller pair 7 to the first folding roller pair 6, faces before and after the sheet folded portion Pb are placed therebetween, and a gap of the faces before and after the sheet folding portion Pb is reduced. In other words, to ensure that the faces before and after the sheet folded portion Pb do not become distant from each other, the first sheet guiding member 4 and the second sheet guiding member 5 can be used to place the respective faces therebetween, preventing a folding offset by preventing an offset of the faces before and after the sheet folded portion Pb.

In FIG. 17, a transfer to the operation in FIG. 10 is made while placing of the faces before and after the sheet folded portion Pb by the first sheet guiding member 4 and the second sheet guiding member 5 therebetween is operated by the second sheet guiding member 5 when the sheet folded portion Pb is guided from the first folding roller pair 6 to the opposing second folding roller pair 7, whereas it is operated by the first sheet guiding member 4 when it is guided from the second folding roller pair 7 to the opposing first folding roller pair 6*b*, and the gap of the faces in before and after the sheet folded portion Pb is reduced. Therefore, being the same as the first and the second sheet guiding members 4 and 5 for guiding the sheet folded portion Pb to the opposing folding roller pairs 6 and 7, guiding of the sheet folded portion Pb to the opposing folding roller pairs 6 and 7 and preventing of a folding offset are performed in a one time operation of the first sheet guiding member 4 or the second sheet guiding member 5.

In FIG. 17, the first sheet guiding member 4 and the second sheet guiding member 5 are stopped with a condition that a gap of the faces before and after the sheet folded portion Pb is reduced at a time of an operation of placing of the faces before and after the sheet folding portion Pb by the first sheet guiding member 4 and the second sheet guiding member 5 therebetween. The operations of the conveying roller pair 3, the first folding roller pair 6, and the second folding roller pair 7 at that time are continued. Then, an operation is started again in alignment with operations of the first sheet guiding member 4 and the second sheet guiding member 5 when the sheet folded portion Pb is guided from the first folding roller pair 6 to the second folding roller pair or from the second folding roller pair 7 to the first folding roller pair 6.

In other words, it is ensured that the operation of the first sheet guiding member 4 and the second sheet guiding member 5 be stopped in the middle of an operation of the second sheet guiding member 5 when the sheet folded portion Pb is guided from the first folding roller pair 6 to the second folding roller pair 7 and an operation of the first sheet guiding member 4 when the sheet folded portion Pb is guided from the second folding roller pair 7 to the first folding roller pair 6. In other words, an operation of the second sheet guiding member 5 which is arranged on the opposing side of the first sheet guiding member 4 operable to guide it to the first folding roller pair 6 and which is operable to guide it to the second sheet guiding member is an operation intended for a target position. Then, as the stopping is performed after it reaches the target position, a positional relationship stabilizes between the sheet guiding members 5 and 6 and the sheet folded portion Pb and the faces before and after the sheet folded portion Pb, so that prevention of a folding offset and advantageous effects also stabilize.

Figure 18:
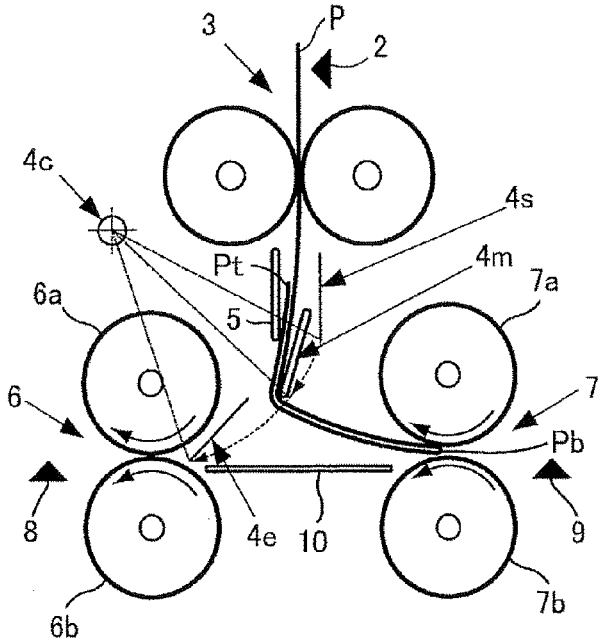
FIG. 18 is a schematic diagram showing a first sheet guiding member folding offset preventing position which is located on a locus which links a first sheet guiding member sheet guiding operation completing position from a first sheet guiding member waiting position.

In FIG. 17, the operation of the first sheet guiding member 4 and the second sheet guiding member 5 is stopped in the middle of an operation of the second sheet guiding member 5 when the sheet folding portion Pb is guided from the first folding roller pair 6 to the second folding roller pair 7 and an operation of the first sheet guiding member 4 when the sheet folded portion Pb is guided from the second folding roller pair 7 to the first folding roller pair 6. The stopping in this way causes a gap of faces before and after the sheet folded portion Pb to be reduced. For an operation of the first sheet guiding member 4 during this operation, as shown in FIG. 18, there is a first sheet guiding member folding offset preventing position 4*m* on a locus which links to a stop position 4*e* after an operation of sheet guiding to the first sheet guiding member 4 from a waiting position 4*s* before an operation of the first sheet guiding member 4, taking, as a reference, an operational reference position 4*c* of the first sheet guiding member 4 as shown in FIG. 18. While not shown, the same also applies to the operation of the second sheet guiding member 5.

Therefore, as only a temporary stop is provided to a sheet guiding member operation at the time of carrying out folding, as changing of control and structure is reduced, a positional relationship between the sheet guiding members 5 and 6 and the sheet folded portion Pb and faces before and after the sheet folded portion Pb is stabilized, so that a folding offset prevention and advantageous effects are also stabilized.

In the above embodiment, the operation of the first sheet guiding member 4 and the second sheet guiding member 5 is stopped in the middle of the operation of the second sheet guiding member 5 when the sheet folded portion Pb is guided from the first folding roller pair 6 to the second folding roller pair 7 and the operation of the first sheet guiding member 4 when the sheet folded portion Pb is guided from the second folding roller pair 7 to the opposing first folding roller pair 6. Performing an operation in this way causes a gap of faces before and after the sheet folded portion Pb to be reduced.

Figure 19:
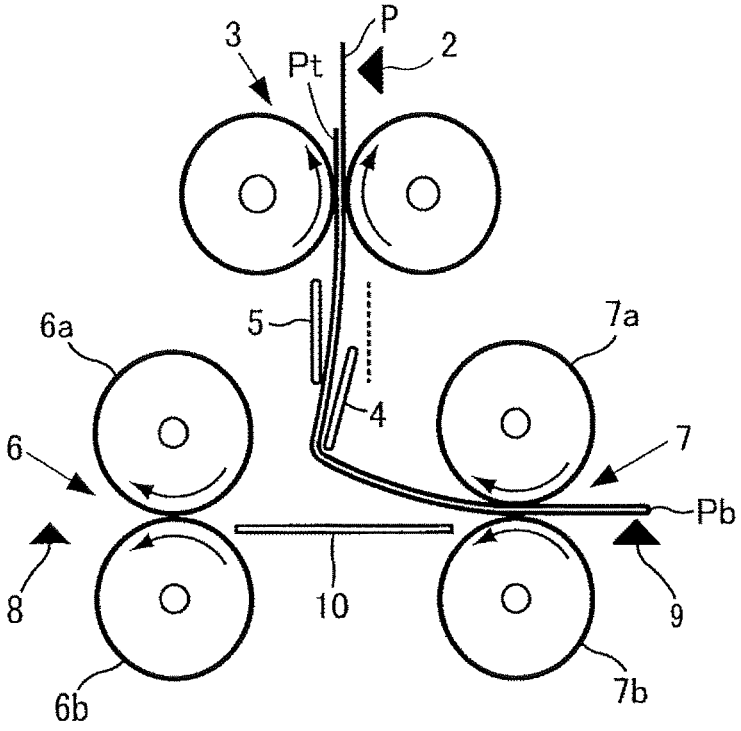
FIG. 19 is a schematic diagram illustrating an operation when the portion in which folding is carried out is guided from the second folding roller pair to the opposing first folding roller pair with a distance being long from a sheet tip to the sheet folded portion.

In addition to this operation, as shown in FIG. 19, a distance from the sheet tip Pt to the sheet folded portion Pb is long, so that the sheet tip Pt must be conveyed up to an upper portion of the conveying roller pair 3 with an operation when the sheet folded portion Pb is guided from the second folding roller pair 7 to the first folding roller pair 6. In this case, the first sheet guiding member 4 and the second sheet guiding member 5 operate in such a manner that they guide the sheet tip Pt to the conveying roller pair 3.

Moreover, in the operation in which the sheet tip Pt is guided to the conveying roller pair 3, it is conveyed while placing by the first sheet guiding member 4 and the second sheet guiding member 5 therebetween faces before and after the sheet folded portion Pb in such a manner that no gap is created between the face after the sheet folded portion Pb and the sheet tip Pt.

Thus, in addition to the respective faces before and after the sheet folded portion Pb being placed therebetween such that they do not become apart from each other and an offset of the faces being prevented, a gap between the face after the sheet folded portion Pb and the sheet tip Pt is reduced. Therefore, reentry into the conveying roller pair 3 of the sheet tip Pt is facilitated and is made smoother, making it possible to handle a wider range of C fold and gate fold.

In the above-described embodiment, a reference at the time of starting operation of the first sheet guiding member 4 and the second sheet guiding member 5 for reducing a gap of faces before and after the sheet folded portion Pb is set to be a position at which is installed some sensor which is provided in the sheet folding apparatus 1.

In other words, in FIG. 6, the sheet tip Pt is detected by the inlet sensor 2, is conveyed from the conveying roller pair 3 to the first folding roller pair 6, and is further detected by the first sensor 8, which is provided outside the first folding roller pair 6. Next, as shown in FIG. 7, the sheet P is conveyed from the first folding roller pair 6 to the second folding roller pair 7 direction, and, as shown in FIG. 8, the sheet folded portion Pb for which folding was carried out by the second folding roller pair 7 is detected by the second sensor 9 which is provided outside the second folding roller pair 7.

In subsequent operations, as shown in FIG. 17, conveying is performed while placing faces before and after the sheet folded portion Pb by the first sheet guiding member 4 and the second sheet guiding member 5 therebetween. The starting reference position of an operation of the first sheet guiding member 4 and the second sheet guiding member 5 at this time is set to be a position at which is installed an inlet sensor 2, a first sensor 8, a second sensor 9, or a dedicated sheet edge detecting sensor (not shown), which is provided in the sheet folding apparatus.

Such a configuration causes the starting reference position of the operation of the first sheet guiding member 4 and the second sheet guiding member 5 to be accurate, and also the positional relationship with respect to the sheet P to be more accurate, so that conveying of the sheet P becomes accurate and stable, making possible to stably prevent a folding offset.

Alternatively, a starting reference position of an operation of the first sheet guiding member 4 and the second sheet guiding member 5 for reducing a gap of faces before and after the sheet folded portion Pb is set to be a position at which is installed a sensor which is provided in the sheet folding apparatus 1. In this case, the sensor which detects the starting reference position is to be the first sensor 8 which is provided outside the first folding roller pair 6 or the second sensor 9 which is provided outside the second folding roller pair 7. In this case, a reference at the time of starting an operation of the first sheet guiding member 4 and the second sheet guiding member 5 may be known from an output change of each sensor that is produced by switching in a sheet conveying direction that occurs immediately preceding the respective operations. In other words, a starting reference position of an operation of the respective sheet guiding members 4 and 5 is set to be a position at which is installed a sensor provided in the sheet folding apparatus 1, causing an operation start of the respective sheet guiding members 4 and 5 to be accurate, a positional relationship with respect to the sheet P to be more accurate, so that conveying of the sheet P becomes accurate and stable, making it possible to stably prevent a folding offset.

In the above-described embodiment, as shown in FIG. 17, the first sheet guiding member 4 and the second sheet guiding member 5 are stopped with a condition that a gap of the faces before and after the sheet folded portion Pb is reduced at a time of an operation of placing the faces before and after the sheet folded portion Pb by the first sheet guiding member 4 and the second sheet guiding member 5 therebetween. The operations of the conveying roller pair 3, the first folding roller pair 6, and the second folding roller pair 7 at that time are continued. Then, an operation is started again in alignment with the operations of the first sheet guiding member 4 and the second sheet guiding member 5 when the sheet folded portion Pb is guided from the first folding roller pair 6 to the second folding roller pair 7 or when it is guided from the second folding roller pair 7 to the first folding roller pair 6. In this case, a position at which the first sheet guiding member 4 and the second sheet guiding member 5 are caused to be stopped may be arranged to be changeable in accordance with conditions such as type and temperature/moisture of the sheet P, whether there is a reentry into a conveying roller pair 3 of the sheet tip Pt, etc.

In other words, a gap with the face after the sheet folded portion Pb differs depending on conditions from the sheet tip Pt to the sheet folded portion Pb, so that an amount of movement of the first sheet guiding member 4 and the second sheet guiding member 5 is changed in accordance with a magnitude of the gap. When the gap is large, the amount of movement of the first sheet guiding member 4 and the second sheet guiding member 5 is increased, while, when the gap is small, the amount of movement of the first sheet guiding member 4 and the second sheet guiding member 5 is decreased.

Such a configuration causes a reference starting position of an operation of a sheet guiding member to be a detecting position of the sheet folded portion Pb which are placed by the first folding roller pair 6 and the second folding roller pair 7 therebetween. Detecting of the sheet folded portion Pb may be performed by a sensor which is installed in an existing sheet folding apparatus 1, making it possible to more accurately and stably prevent a folding offset without additional components.

Now, as shown in FIG. 17, the first sheet guiding member 4 and the second sheet guiding member 5 are stopped with the above-described condition that the gap of the faces before and after the sheet folded portion Pb is reduced at a time of an operation of placing the faces before and after the sheet folded portion Pb by the first sheet guiding member 4 and the second sheet guiding member 5 therebetween. An operation of the conveying roller pair 3, the first folding roller pair 6, and the second folding roller pair 7 at that time is continued, and the sheet folded portion Pb is guided from the first folding roller pair 6 to the second folding roller pair 7, or from the second folding roller pair 7 to the first folding roller pair 6. An operation is started again in alignment with the first sheet guiding member 4 and the second sheet guiding member 5. In such a case, a stopping position at which the first sheet guiding member 4 and the second sheet guiding member 5 are stopped may be arranged to be changeable in accordance with conditions such as type, temperature/moisture of the sheet P, whether there is a reentry into a conveying roller pair 3 of the sheet tip Pt, etc.

In other words, a gap with the face after the sheet folded portion Pb differs depending on conditions from the sheet tip Pt to the sheet folded portion Pb, so that an amount of movement of the first sheet guiding member 4 and the second sheet guiding member 5 is changed in accordance with a magnitude of the gap. When the gap is large, the amount of movement of the first sheet guiding member 4 and the second sheet guiding member 5 is increased, while, when the gap is small, the amount of movement of the first sheet guiding member 4 and the second sheet guiding member 5 is decreased.

In this way, a target position of an operation of the first sheet guiding member 4 or the second sheet guiding member 5 is changed in accordance with an environment such as type, temperature/moisture of the sheet P, whether there is a reentry into a conveying roller pair 3 of the sheet tip Pt in accordance with a folding length of the sheet P, etc., making it more difficult to be impacted by environment, sheet type, and folding specification.

Moreover, an image forming apparatus 100 which includes such a sheet folding apparatus 1 can perform sheet folding in a series of operations immediately after image forming, such as direct sheet folding from manuscript copying, direct sheet folding from printer outputting, sheet folding from facsimile transmitting.

The present application is based on Japanese Priority Applications No. 2012-062782 filed on Mar. 19, 2012 and No. 2013-008594 filed on Jan. 21, 2013, the entire contents of which are hereby incorporated by reference.

The invention claimed is:

1. A sheet folding apparatus, comprising:

a conveying roller pair configured to feed a sheet;

a first roller pair configured to fold the sheet fed from the conveying roller pair;

a second folding roller pair configured to fold the sheet fed from the conveying roller pair in conjunction with the first folding roller pair which is in an opposing manner and at a predetermined gap therewith;

a first sheet detecting unit configured to detect a sheet edge on the first folding roller pair side and a second sheet detecting unit configured to detect a sheet edge on the second folding roller side, the first sheet detecting unit and second sheet detecting unit being outside an opposing area of the first folding roller pair and the second folding roller pair;

a first sheet guiding member configured to guide the sheet fed by the conveying roller pair to the first folding roller pair; and a second sheet guiding member on the side opposing the first sheet guiding member and configured to guide the sheet fed by the conveying roller pair to the second folding roller pair, wherein:

the first and second sheet guiding members are substantially parallel when the sheet is fed by the conveying roller pair;

the first sheet guiding member and the second sheet guiding member are operated in accordance with a specified sheet folding scheme, the sheet conveyed from the conveying roller pair is guided to the first folding roller pair or the second folding roller pair, a sheet edge is detected by the first sheet detecting unit or the second sheet detecting unit, a sheet conveying direction and a sheet conveying distance are controlled based on the detected result, timings of the operation of the first sheet guiding member or the second sheet guiding member and conveying of the sheet by the first folding roller pair and the second folding roller pair are aligned, and the sheet is folded while being placed by the first folding roller pair or the second folding roller pair therebetween, and the sheet folded portion is detected by the first sheet detecting unit or the second detecting unit and in accordance with control of the sheet conveying direction and the sheet conveying distance based on the detected result, the sheet folded portion for which folding was performed by the first folding roller pair or the second folding roller pair is guided to either of the first folding roller pair and the second roller pair that are arranged in an opposing manner, the sheet folded portion is detected by the first sheet detecting unit or the second detecting unit and the sheet conveying direction and the sheet conveying distance is controlled based on the detected result, timings of the operation of the sheet guiding member and conveying of the sheet by the first folding roller pair and the second folding roller pair are aligned, and the sheet is folded while being placed by the first folding roller pair or the second folding roller pair therebetween.

2. The sheet folding apparatus as claimed in claim 1, wherein, when the sheet folded portion is guided from one of the first folding roller pair and the second folding roller pair to one opposing the one of the first folding roller pair and the second folding roller pair, the first sheet guiding member which is operable to guide it to the first folding roller pair and a second sheet guiding member which is operable to guide it to the second folding roller pair which is arranged on the side opposing the first sheet guide member are used to place therebetween faces before and after the sheet folded portion such that they are not apart from each other.

3. The sheet folding apparatus as claimed in claim 2, wherein, in an operation of the first sheet guiding member and the second sheet guiding member when the sheet folded portion is guided from one of the first folding roller pair and the second folding roller pair to the opposing one of the first folding roller pair and the second folding roller pair, the second sheet guiding member operates when the sheet folded portion is guided from the first folding roller pair to the opposing second folding roller pair and the first sheet guiding member operates when it is guided from the second folding roller pair to the opposing first folding roller pair.

4. The sheet folding apparatus as claimed in claim 2, wherein the operation of the first sheet guiding member and the second sheet guiding member when the sheet folded portion is guided from one of the first folding roller pair and the second folding roller pair to the opposing one of the first folding roller pair and the second folding roller pair is an operation intended for a target position, so that it is stopped after reaching the target position.

5. The sheet folding apparatus as claimed in claim 4, wherein the target position of the first sheet guiding member or the second sheet guiding member is located between a waiting position before an operation in which a tip of the sheet is guided from the conveying roller pair to the first folding roller pair or the second folding roller pair and a stop position after an operation in which the tip of the sheet is guided from the conveying roller pair to the first folding roller pair or the second folding roller pair.

6. The sheet folding apparatus as claimed in claim 4, wherein an operation target position of the first sheet guiding member or the second sheet guiding member is arranged to be changeable in accordance with conditions of temperature/moisture, a type of the sheet, or whether there is a reentry into the conveying roller pair of the sheet tip due to a folding length of the sheet.

7. the sheet folding apparatus as claimed in claim 2, wherein the operation of the first sheet guiding member and the second sheet guiding member when the sheet folded portion is guided from one of the first folding roller pair and the second folding roller pair to the opposing one of the first folding roller pair and the second folding roller pair is an operation which makes a reentry of the sheet tip into the conveying roller pair smooth.

8. The sheet folding apparatus as claimed in claim 7, wherein a starting reference position of an operation of the first sheet guiding member or the second sheet guiding member is a position at which the first sheet detecting unit or the second sheet detecting unit is installed.

9. The sheet folding apparatus as claimed in claim 8, wherein the starting reference position of the operation of the first sheet guiding member or the second sheet guiding member is arranged outside the opposing area of the first folding roller pair and the second folding roller pair and is a position at which are installed a first sheet detecting unit which detects a sheet edge on the first folding roller pair side and a second sheet detecting unit which detects a sheet edge on the second folding roller pair side.

10. An image forming apparatus having an image forming unit which forms an image onto a sheet, comprising the sheet folding apparatus as claimed in claim 1.

11. The sheet folding apparatus of claim 1, wherein the first and second sheet guiding members are located inside an area defined by outside boundaries of the conveying roller pair.

* * * * *